US005432398A

United States Patent [19]

Kogelschatz

[11] Patent Number: 5,432,398

[45] Date of Patent: Jul. 11, 1995

[54] HIGH-POWER RADIATOR WITH LOCAL FIELD DISTORTION FOR RELIABLE IGNITION

[75] Inventor: Ulrich Kogelschatz, Hausen, Switzerland

[73] Assignee: Heraeus Noblelight GmbH, Hanau, Germany

[21] Appl. No.: 83,531

[22] Filed: Jun. 30, 1993

[30] Foreign Application Priority Data

Jul. 6, 1992 [DE] Germany ..... 42 22 130.7

[51] Int. Cl.[6] ..... H01J 7/24

[52] U.S. Cl. ..... 313/25; 313/36; 313/607; 313/234

[58] Field of Search ..... 313/17, 25, 32, 36, 313/232, 234, 573, 607, 609, 634

[56] References Cited

U.S. PATENT DOCUMENTS 4,845,408 7/1989 Pai ..... 353/609
5,013,959 5/1991 Kogelschatz .

FOREIGN PATENT DOCUMENTS 0054111 6/1982 European Pat. Off. .
0184214 6/1986 European Pat. Off. .
0254111 1/1988 European Pat. Off. .
0449018A2 10/1991 European Pat. Off. .
0477914 4/1992 European Pat. Off. .
0547366 6/1993 European Pat. Off. .
618261 9/1935 Germany .
633760 8/1936 Germany .
761839 10/1954 Germany .
4010809A1 10/1990 Germany .

OTHER PUBLICATIONS

Patent Abstracts of Japan, vol. 11, No. 55 (E-481) (2502), Feb. 20, 1987, JP-A-61 216 232, Sep. 25, 1986.

*Primary Examiner*—Sandra L. O'Shea
*Assistant Examiner*—Vip Patel
*Attorney, Agent, or Firm*—Oblon, Spivak, McClelland, Maier, & Neustadt

[57] ABSTRACT

In a UV excimer radiator, the ignition behavior during the initial ignition or relatively long operating pauses is improved by providing means for local field distortion in the discharge space. These means can either be local constrictions provided in a pinpointed fashion or a disturbing body made from aluminum oxide or titanium oxide.

20 Claims, 1 Drawing Sheet

HIGH-POWER RADIATOR WITH LOCAL FIELD DISTORTION FOR RELIABLE IGNITION

BACKGROUND OF THE INVENTION

1. Field of the Invention

The invention relates to a high-power radiator, in particular for ultraviolet light, having a discharge space which is filled with a filling gas that emits radiation under discharge conditions and whose walls are formed by an outer and an inner dielectric, the outer surfaces of the outer dielectric being provided with first electrodes, with second electrodes on the surface of the second dielectric averted from the discharge space, and with an AC source, connected to the first and second electrodes, for supplying the discharge.

In this regard, the invention refers to a prior art such as emerges, for example, from EP-A 054,111, U.S. patent application No. 07/485544 dated Feb. 27, 1990, or else EP Patent Application 90103082.5 dated Feb. 17, 1990.

2. Discussion of Background

The industrial use of photochemical methods depends strongly on the availability of suitable UV sources. The classic UV radiators deliver low to medium UV intensities at a few discrete wavelengths such as, for example, the low-pressure mercury lamps at 185 nm and, in particular, at 254 nm. Truly high UV outputs are obtained only from high-pressure lamps (Xe, Hg) which then, however, distribute their radiation over a larger wavelength region. The new excimer lasers have provided a few new wavelengths for fundamental photochemical experiments, but for reasons of cost they are presently suitable for an industrial process only in exceptional cases.

In the EP patent application mentioned at the beginning or in the conference print "Neue UV- und VUV Excimerstrahler" ("New UV and VUV Excimer radiators") by U. Kogelschatz and B. Eliasson, distributed at the 10th Lecture Conference of the Gesellschaft Deutscher Chemiker (German Chemical Society), Specialist Group on Photochemistry, in Wärzburg (FRG), 18–20th November 1987, a novel excimer radiator is described. This novel type of radiator is based on the principle that it is possible to generate excimer radiation even in silent electrical discharges, a type of discharge which is used on a large scale in ozone generation. In the current filaments of this discharge, which are present only briefly (<1 microsecond), electron impact excites noble gas atoms which react further-to form excited molecular complexes (excimers). These excimers live only a few 100 nanoseconds and upon decomposing dissipate binding energy in the form of UV radiation.

Excimer UV radiators based on the principle of silent electrical discharges require during initial ignition or after relatively long pauses a substantially higher voltage than the voltage required for normal operation. This is bound up with the fact that during operation surface charges form on the dielectrics and in each case ensure easier ignition in the following voltage half wave. These surface charges are lacking during initial ignition and after relatively long pauses.

It may be said in purely general terms that it is necessary to fulfill two criteria for igniting a gas discharge. On the one hand, starting electrons must be present and on the other hand, the electrical field strength must exceed a critical value (ignition criterion), so that it is possible for there to be an adequate multiplication of the starting electrons and thus for electron avalanches to form under the influence of the applied electric field.

Methods known from lamp technology are the use of a radioactive preparate (for example, thorium) or gas (krypton 85) in order to make starting electrons available and of an overvoltage pulse in order to increase the starting field strength. The latter measure, in particular, requires an additional outlay in designing the electrical feed equipment and the insulation level of cables, plugs, holders, etc.

SUMMARY OF THE INVENTION

Accordingly, one object of this invention is to provide, proceeding from the prior art, a novel high-power radiator, in particular for UV or VUV radiation which ignites reliably without expensive measures.

In order to achieve this object, it is provided according to the invention in a high-power radiator of the type mentioned at the beginning that means for local field distortion are provided in the discharge space.

In this regard, the invention is based on the finding of forcing an initial ignition at a point by a local field distortion or field increase. The reliable ignition of the entire discharge volume is then forced by the UV radiation and the charge carriers of this local discharge which are thereby produced.

The local field distortion can be caused, for example, by constricting the discharge gap, for example a dent or hump directed towards the gap volume, or preferably by a disturbing body made from dielectric material in the discharge gap. This last-named variant can be realised in a simple way by means of a quartz ball or of a ball made from aluminum oxide or titanium oxide.

The invention renders it possible for the first time to provide excimer UV radiators which ignite reliably. The measures to be taken in this case are simple and economic. In the event of the use of a disturbing body, which is to be regarded as the most preferred means for field distortion, they can also be carried out subsequently in existing units.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
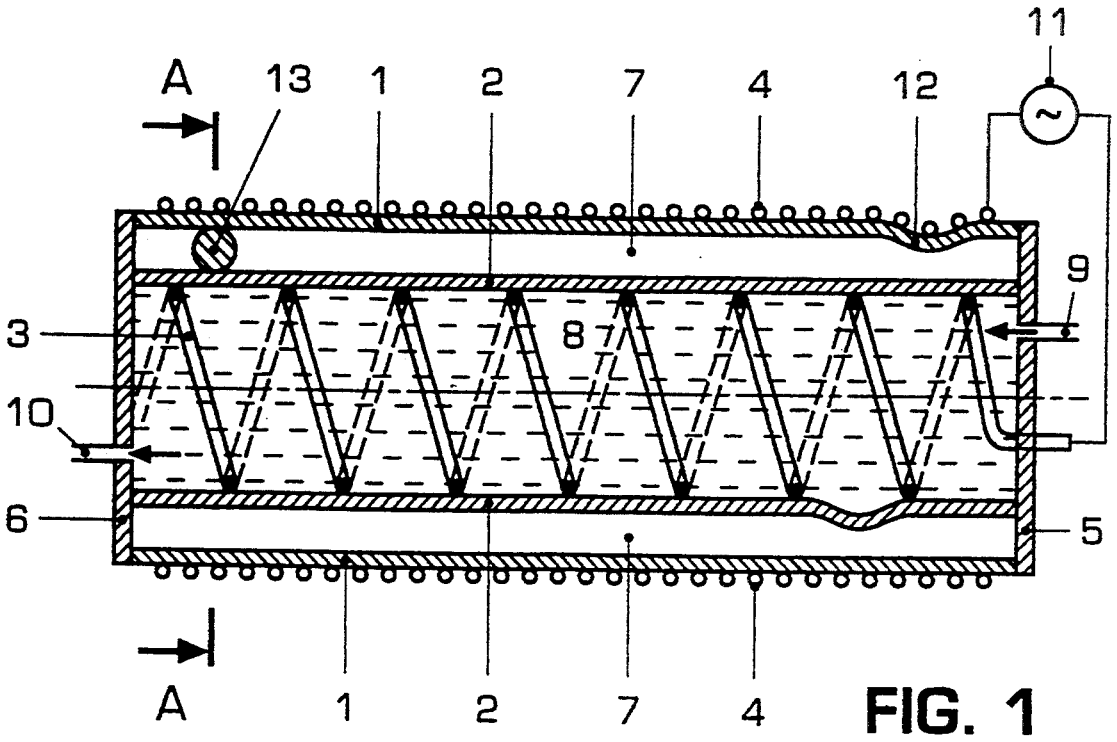
FIG. 1 shows a UV cylindrical radiator with a concentric arrangement of inner and outer electric tubes, in longitudinal section.
Figure 2:
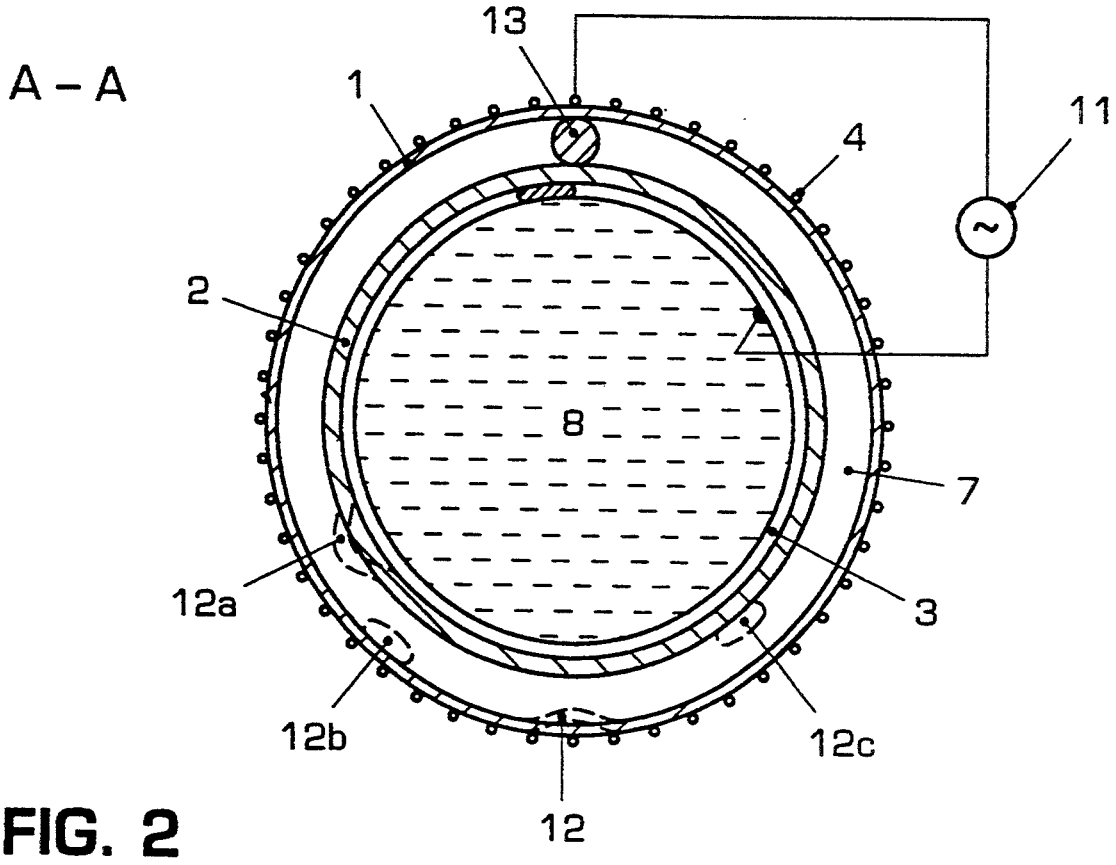
FIG. 2 shows a section through the UV radiator according to FIG. 1, along the line AA therein.

Referring now to the drawings, wherein like reference numerals designate identical or corresponding parts throughout the several views, in accordance with FIGS. 1 and 2 an inner quartz tube 2 is arranged coaxially in an outer quartz tube 1 having a wall thickness of approximately 0.5 to 1.5 mm and an outside diameter of approximately 20 to 30 mm. A helical inner electrode 3 bears against the inner surface of the inner quartz tube 2.

An outer electrode 4 in the form of a wire grid or a mounted electrode structure extends over the entire outer circumference of the outer quartz tube 1.

A wire 3 is inserted into the inner quartz tube 2. The wire forms the inner electrode of the radiator, the wire grid 4 forming the outer electrode of the radiator. The quartz tubes 1 and 2 are sealed or melted closed at both ends in each case by means of a cover 5 and 6, respectively. The space between the two tubes 1 and 2, the discharge space 7, is filled with a gas/gas mixture that emits radiation under discharge conditions. The interior 8 of the inner quartz tube 2 is filled with a liquid having a high dielectric constant, preferably demineralized water ($\epsilon=81$). Said liquid serves at the same time for cooling the radiator. The cooling liquid is fed and discharged via the connections 9 and 10, respectively. The cooling liquid also serves the purpose of electrically coupling the inner electrode 3 to the inner quartz tube 2, so that it is not necessary for the helical electrode 3 to bear against the inner wall overall.

The two electrodes 3 and 4 are connected to the two poles of an AC source 11. The AC source delivers an adjustable AC voltage of the order of magnitude of several 100 volts to 20,000 volts at frequencies in the range of the supply alternating current as far as a few 1000 kHz—depending on the electrode geometry, pressure in the discharge space and composition of the filling gas.

The filling gas is, for example, mercury, a noble gas, a noble gas/metal vapor mixture, a noble gas/halogen mixture, possibly with the use of an additional further noble gas, preferably Ar, He, Ne, as buffer gas.

Depending on the desired spectral composition of the radiation, use can be made in this case of a substance/-substance mixture in accordance with the following table:

| Filling Gas | Radiation |
|---|---|
| Helium | 60–100 nm |
| Neon | 80–90 nm |
| Argon | 107–165 nm |
| Argon + fluorine | 180–200 nm |
| Argon + chlorine | 165–190 nm |
| Argon + krypton + chlorine | 165–190, 200–240 nm |
| Xenon | 160–190 nm |
| Nitrogen | 337–415 nm |
| Krypton | 124, 140–160 nm |
| Krypton + fluorine | 240–255 nm |
| Krypton + chlorine | 200–240 nm |
| Mercury | 185,254,320–370,390–420 nm |
| Selenium | 196, 204, 206 nm |
| Deuterium | 150–250 nm |
| Xenon + fluorine | 340–360 nm, 400–550 nm |
| Xenon + chlorine | 300–320 nm |

In addition, a whole series of further filling gases come into consideration:

- a noble gas ( Ar, He, Kr, Ne, Xe ) or Hg with a gas or vapor from $F_2$ , $J_2$, $Br_2$ , $Cl_2$, or a compound which eliminates one or more atoms of F, J, Br or Cl in the discharge;
- a noble gas ( Ar, He, Kr, Ne, Xe ) or Hg with $O_2$ or a compound which eliminates one or more O atoms in the discharge;
- a noble gas (Ar, He, Kr, Ne, Xe) with Hg.

Upon applying an alternating voltage between the electrodes 3 and 4, a multiplicity of discharge channels (partial discharges) are formed in the discharge space 7. These interact with the atoms/molecules of the filling gas, which in the end leads to UV or VUV radiation.

In the silent electrical discharge that forms, the electron energy distribution can be optimally set by the thickness of the dielectrics and their properties as well as pressure and/or temperature in the discharge space.

Excimer UV radiators are known to this extent.

In order, now, to solve the ignition problem described at the beginning, a series of possibilities are provided according to the invention, all of which are based on the idea of locally forcing a field distortion or field increase at a point in the discharge space 7. The UV radiation thereby produced and the charge carriers of this local discharge then force the reliable ignition of the entire discharge volume.

A first variant is represented in the right-hand upper half of FIG. 1 (dashed in FIG. 2). The outer dielectric tube 1 is provided with a dent or hump 12 pointing inwards. The dent or hump reaches approximately as far as half the gap width towards the inner dielectric tube 2.

A second variant is shown in the right-hand lower half of FIG. 1 (likewise dashed in FIG. 2). The inner dielectric tube 2 is provided there with a dent or hump **12*a* which reaches approximately as far as half the gap width towards the outer dielectric tube 1**.

Whereas these two variants of the field distortion would have to be provided from the start, the embodiment represented in the left-hand half of FIG. 1 and in FIG. 2 can also be used subsequently in the case of finished radiators.

A ball 13 made from dielectric material, for example quartz, preferably from aluminum oxide or titanium oxide and having an outside ball diameter. equal to or less than the gap width of the discharge space 7 is inserted into the discharge space 7. The ball can—but need not—be attached to one or both dielectric walls. The precise ball geometry is not important here. It is also possible to provide two or more of said balls, particularly in the case of elongated radiators. The combination of ball(s) and dents or humps is also possible.

A further measure, which can certainly also be taken subsequently in the case of radiators, consists in melting quartz drops **12*b* or 12*c* onto the inner surface of the outer dielectric tube 1 or onto the outer surface of the inner dielectric tube 2**, in order to achieve the desired field distortion.

Obviously, numerous modifications and variations of the present invention are possible in light of the above teachings. It is therefore to be understood that within the scope of the appended claims, the invention may be practiced otherwise then as specifically described herein.

What is claimed as new and desired to be secured by letters patent of the United States is:

1. A high-power radiator, comprising a discharge space which is filled with a filling gas that emits radiation under discharge conditions, outer and inner walls defining said discharge space formed by an outer and an inner dielectric, an outer surface of the outer dielectric being provided with a first electrode, with second electrodes provided on the surface of the second dielectric and averted from the discharge space, and an AC source, connected to the first and second electrodes, wherein means are provided in the discharge space for local field distortion.

2. The high-power radiator as claimed in claim 1, wherein the means for local field distortion are formed by local restriction of the discharge space.

3. The high-power radiator as claimed in claim 2, wherein the local restriction is a dent or hump on at least one of said walls, facing the discharge space, which dent or hump is integrally formed with the inner dielectric, outer dielectric or both.

4. The high-power radiator as claimed in claim 3, wherein said discharge space has a gap width between said inner and outer walls, and wherein said dent or hump extends to about one half the gap width into said discharge space.

5. The high-power radiator as claimed in claim 2, wherein the local restriction is constructed by applying additional material consisting of dielectric material to at least one of said walls, said additional material applied so as to face the discharge space.

6. The high-power radiator as claimed in claim 5, wherein said inner and outer walls defining said discharge space are walls of two concentric coaxial cylinders.

7. The high-power radiator as claimed in claim 6, wherein said two concentric coaxial cylinders are made of quartz.

8. The high-power radiator as claimed in claim 2, wherein said inner and outer walls defining said discharge space are walls of two concentric coaxial cylinders.

9. The high-power radiator as claimed in claim 8, wherein said two concentric coaxial cylinders are made of quartz.

10. The high-power radiator as claimed in claim 3, wherein said inner and outer walls defining said discharge space are walls of two concentric coaxial cylinders.

11. The high-power radiator as claimed in claim 10, wherein said two concentric coaxial cylinders are made of quartz.

12. The high-power radiator as claimed in claim 11 wherein said discharge space has a gap width between said inner and outer walls, and wherein said dent or hump extends to about one half the gap width into said discharge space.

13. The high power radiator as claimed in claim 1, wherein said means for local field distortion is one or more disturbing bodies made from dielectric material provided in the discharge space in contact with the inner dielectric, the outer dielectric, or both.

14. The high-power radiator as claimed in claim 13, wherein the one or more disturbing bodies consist of quartz, aluminum oxide or titanium oxide.

15. The high-power radiator as claimed in claim 13, wherein said inner and outer walls defining said discharge space are walls of two concentric coaxial cylinders.

16. The high-power radiator as claimed in claim 15, wherein said two concentric coaxial cylinders are made of quartz.

17. The high-power radiator as claimed in claim 14, wherein said inner and outer walls defining said discharge space are walls of two concentric coaxial cylinders.

18. The high-power radiator as claimed in claim 17, wherein said two concentric coaxial cylinders are made of quartz.

19. The high-power radiator as claimed in claim 1, wherein said inner and outer walls defining said discharge space are walls of two concentric coaxial cylinders.

20. The high-power radiator as claimed in claim 19, wherein said two concentric coaxial cylinders are made of quartz.

* * * * *